United States Patent [19]

Rix et al.

[11] Patent Number: 5,067,464

[45] Date of Patent: Nov. 26, 1991

[54] FUEL INJECTOR FOR AN INTERNAL COMBUSTION ENGINE

[75] Inventors: David M. Rix; Martin W. Long; Thomas R. Lee; Douglas E. Dawes, all of Columbus, Ind.

[73] Assignee: Cummins Engine Company, Inc., Columbus, Ind.

[21] Appl. No.: 501,030

[22] Filed: Mar. 29, 1990

[51] Int. Cl.[5] ..... F12M 59/02

[52] U.S. Cl. ..... 123/446; 123/501; 239/89

[58] Field of Search ..... 123/446, 447, 458, 500, 123/501, 506

[56] References Cited

U.S. PATENT DOCUMENTS

| | | | |
|---|---|---|---|
| 4,129,256 | 12/1978 | Bader, Jr. et al. | 123/506 |
| 4,531,672 | 7/1985 | Smith | 123/446 |
| 4,653,448 | 3/1987 | Ohmori | 123/501 |
| 4,653,455 | 3/1987 | Eblen | 123/458 |
| 4,709,679 | 12/1987 | Djordevic | 123/447 |
| 4,805,580 | 2/1989 | Buisson | 123/447 |

FOREIGN PATENT DOCUMENTS

| | | | |
|---|---|---|---|
| 0096165 | 6/1983 | Japan | 123/446 |
| 0099061 | 6/1984 | Japan | 123/447 |

OTHER PUBLICATIONS

Ronald B. Lannan, Albert E. Sisson and William G. Wolber entitled "Cummins Electronic Controls For Heavy Duty Diesel Engines", published in International Congress on Transportation Electronics Proceedings, Oct. 17-18, 1988, Library of Congress Catalog Card Number 87-83470.

*Primary Examiner*—Carl Stuart Miller
*Assistant Examiner*—Erick Solis
*Attorney, Agent, or Firm*—Neuman, Williams, Anderson & Olson

[57] ABSTRACT

A mechanically pressurized electronic fuel injector for use in internal combustion engines is actuated by the engine valve train during the injection stroke. A control solenoid is mounted to the injector and has its axis inclined with respect to the axis of the injector. A control valve passage has its axis generally coaxial with the central axis of the control solenoid. Machining of the control valve passage is accomplished through the receiving boss for the control solenoid. High pressure sealing plugs, previously required to seal orifices in the exterior surface of the injector body which were needed to provide access to drill or machine the control valve passage, are completely eliminated. The drilling and machining of the control valve passage is accomplished without drilling through the exterior surface of the injector body.

7 Claims, 2 Drawing Sheets

FUEL INJECTOR FOR AN INTERNAL COMBUSTION ENGINE

FIELD OF THE INVENTION

The present invention relates to a fuel injector for an internal combustion engine and more specifically to a fuel injector in which the fuel passages exposed to injection pressures are positioned so that the machining of the passages is performed without leaving orifices in the exterior body of the fuel injector which would require sealing plugs.

BACKGROUND OF INVENTION

Electronic fuel injectors are frequently used in today's internal combustion engines. The electronic fuel injector provides precise and reliable fuel delivery into the cylinder of compression ignition and spark ignition engines. The precision and reliability of the electronic fuel injector have contributed to the goals of fuel efficiency, maximum practicable power output and control of undesirable products of combustion. These and other benefits of electronic fuel injection systems are well known and are appropriately used to beneficial effect in the design of modern internal combustion engines.

Known electronic fuel injectors, especially those designed for application in spark ignition or compression ignition engines, utilize means to enhance fuel charge pressurization. Enhanced fuel charge pressurization is desirable during the fuel injection event to assure proper atomization and spray distribution of the fuel into the engine cylinder or prechamber. In addition, it is desirable to be able to determine the quantity of fuel used and to control the injection timing for several reasons, including obtaining full combustion of the fuel to control particulate emissions. This has been of great interest in recent years, owing to environment concerns and regulatory incentives. Finally, the proper control of fuel injectors reduces the amount of residual particulate formed in the compression ignition engine cylinder.

Several known types of fuel injectors include a means which enhances the pressurization of the fuel charge. These fuel injectors typically have mechanical linkage systems coupled to the engine camshaft and/or cylinder head valve train assembly. Such fuel injectors are configured so that the camshaft or other rotating or reciprocating member acts on an injector push rod either directly or indirectly through a rocker arm.

The link is generally vertically oriented with respect to the injector. Displacement of the link in the downward direction (along the vertical axis) also causes an injector coupling to move downward within a bore created in the fuel injector body. The coupling is spring loaded and is returned to its original position by the bias force of a coupling return spring. The injector coupling is attached to a timing plunger and movement of the coupling causes relative movement of the timing plunger. When the injection coupling moves downward, the timing plunger moves downward into a timing plunger chamber, which causes a metering plunger to move in a metering plunger chamber which contains a prefilled and measured volume of fuel. The movement of the metering plunger provides additional pressure to the fuel charge in the metering plunger chamber exceeding the pressure of the rail fuel (fuel delivered to the injector from the fuel pump at about 150 psi). This additional pressure, after exceeding a certain pressure threshold, causes an injector nozzle to open and allows the fuel to flow through the injector nozzle into a combustion chamber or equivalent structure at very high pressure. The return stroke of the timing plunger is generally facilitated by the use of the return spring force acting on the attached coupling.

Control of the injection sequence, relative to the timing and volume of the fuel injected into the engine cylinder or equivalent structure, is often accomplished with an electronically actuated control valve. The actuation of the control valve is achieved by means well known in the art, especially including a control solenoid, which is typically situated parallel to the central axis of the injector body due to space limitations existing in the valve train assembly. Passages are machined within the injector body to allow the transportation of fuel at the rail fuel pressure of 150 psi between the control valve operable by the control valve solenoid and the timing plunger chamber during the metering stroke, and allow preinjection backflow to occur during the injection stroke. By selectively opening and closing the control valve via the control solenoid, the amount of fuel flowing through the passages into the injector can be directly or indirectly metered. Due to the often complicated passage formations necessary to allow fuel transportation between the two parallel axis of the control solenoid and the injector body, it is typically necessary to perform drilling and machining operations in the formation of the passages which require access orifices and channels through the exterior surface of the injector body, which are subsequently sealed with high pressure plugs.

Further, in some injector configurations, the amount of fuel to be injected is established by using a timing plunger chamber in series with the axial motion of the injector link, coupling member, timing plunger, metering plunger and metering plunger chamber. The timing plunger chamber is located between the timing plunger and the metering plunger. The timing plunger chamber controls admitting fuel at 150 psi and thus the upward motion of the metering plunger by balancing the fluid pressure acting on both axial ends of the metering plunger. As the injection stroke progresses, pressurization of the timing plunger chamber is avoided by allowing the fuel contained therein to flow back through the control valve passage and control valve. Thus, the control solenoid can be used to control preinjection back flow from the timing plunger chamber back through the injector body passages and the control valve to the fuel rail. This function has the beneficial result of maintaining a constant pressure in the timing plunger chamber and maintaining the proper volume of metered fuel already delivered to the metering chamber.

As the injection sequence continues, the control valve is closed, thus preventing further preinjection backflow. Accordingly, the fuel present in the timing plunger chamber and the metering plunger chamber is subject to increasing pressure as the timing plunger continues and the metering plunger begins their downward travel in the injector body.

The control valve and associated passages in the injector body are fully exposed to the pressurization of the fuel in both the timing plunger chamber and metering chamber throughout the final high pressure phase of the injection stroke. Although the fuel is introduced into the fuel injector at about 150 psi, the peak pressure of the fuel during the injection phase reaches transient pressures of 23,500 psi. These pressures are also exerted against the high pressure plugs used to seal the passages from the exterior of the injector body.

In the fuel injector in common use several years ago the injection pressures were only in the range of 10,000 to 12,000 psi. These pressures did not significantly contribute to plug failures, as these pressures were typically far below the performance limits of the plugs. The higher injection pressures present in modern engines for the reasons noted above are contributing to the increased occurrence of plug failures, as these higher pressures are approaching, if not exceeding, the performance limits of the plugs.

Failure of the plug during engine operation can result in serious damage to the engine. The fuel provided to the injector at fuel rail pressures can escape from the confines of the injector body and flow into the cylinder head. There, the fuel can mix with the engine lubricant and compromise the integrity of the engine lubricant throughout the engine. The use of the diluted engine lubricant with impaired performance characteristics can cause severe and catastrophic failures of key engine sliding surfaces, such as the engine main bearings.

SUMMARY OF THE INVENTION

The problem of orifice plugs dislodging under high pressure in a mechanically pressurized electronic fuel injector of the type described above are solved by the present invention. In the fuel injector of the present invention a control means comprising a control solenoid and a control valve is positioned within a boss or aperture in the body of the injector. The central axis of the control means is inclined relative to the central axis of the fuel injector. The central axis of the boss in the body of the fuel injector is coaxial with the central axis of the control means. A control valve passage in the body of the injector transports fuel between the control valve and the operative elements of the fuel injector. In the preferred embodiment, the central axis of the control valve passage is substantially coaxial with the central axis of the control means and the central axis of the boss. It is also possible for the central axis of the control valve passage to be non-coaxial with the central axis of the boss, provided that the central axis of the control valve passage intersects the opening of the boss on the surface of the injector body, thereby providing access to the control valve passage through the boss. The drilling and the machining of the control valve passage is accomplished through the receiving boss for the control means. Access to the control valve passage is obtainable through the boss and consequently, the drilling and machining of the control vale passage is accomplished without drilling through the exterior surface of the injector body. High pressure plugs are no longer necessary to maintain the integrity of pressures within the injector body and can be completely eliminated. Thus, a simplified, more reliable and effective fuel injector is described satisfying the greater demands of modern spark ignition and compression ignition engines.

The above, and other related features of the present invention will be apparent from a reading of the following description of the drawings and the appended claims.

DETAILED DESCRIPTION OF THE DRAWINGS

Figure 1:
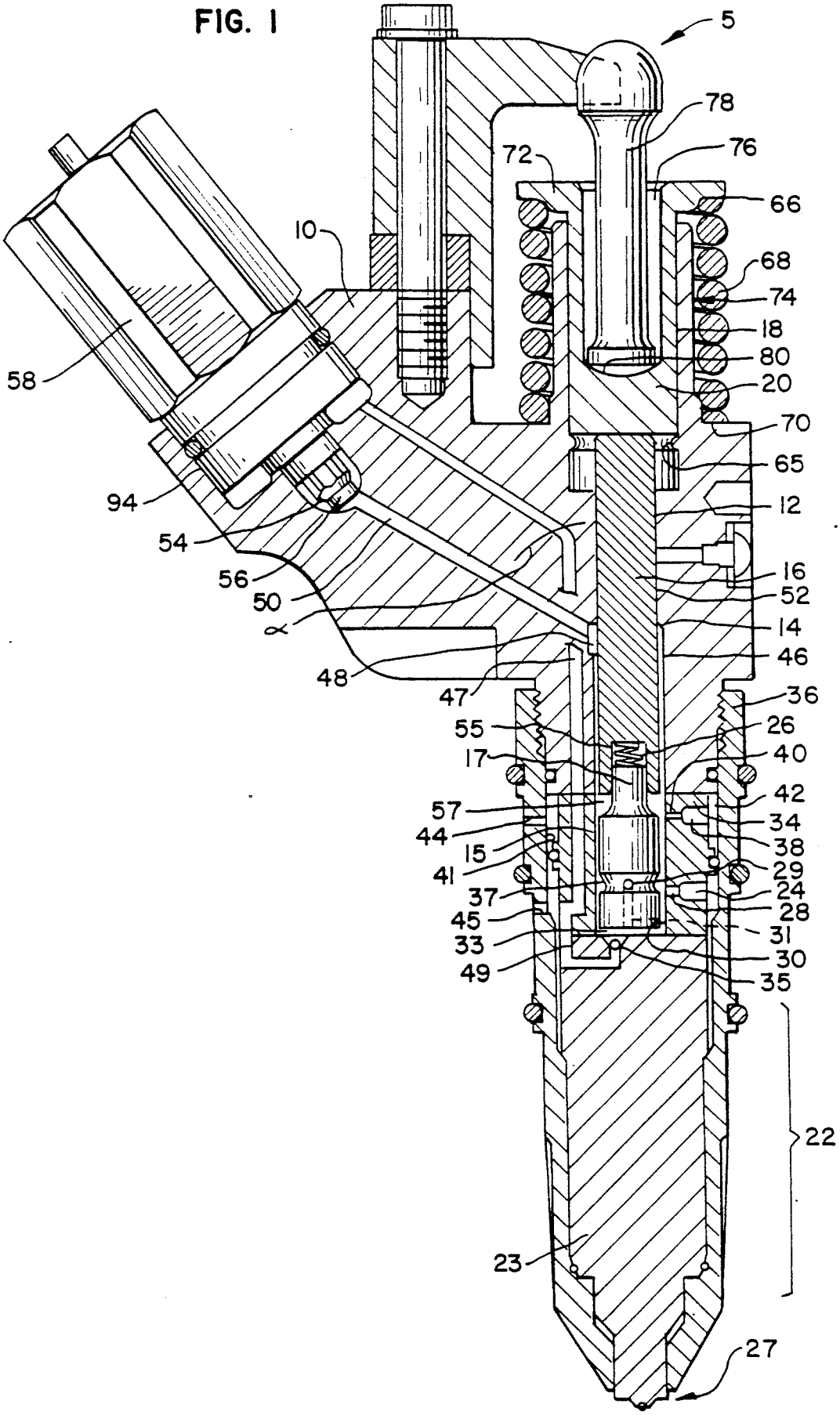
FIG. 1 is a cross-sectional view of a high pressure fuel injector according to the invention herein disclosed.

Referring to the drawings, wherein reference characters designate like or corresponding parts throughout the views, FIG. 1 illustrates the overall configuration of a modern mechanically assisted electronic fuel injection assembly 5. The fuel injector assembly 5 section shown is viewed through the central axis of the injector assembly 5 and reveals the inner portions of the fuel injector 5 and the features of the invention herein disclosed. The injector body 10 is formed preferably as a forged unit, and a central axial cavity 12 extends throughout the length of the injector body 10. The axial cavity 12 is actually comprised of two coaxial and communicating central cylindrical bores of differing inner diameters. The first cylindrical bore 14 slidingly receives a timing plunger 16, while the second cylindrical bore 18 slidingly receives a coupling member 20. A metering plunger 17 is slidingly received in a cylindrical bore 15, formed in a metering barrel 34.

The injector body 10 is connected to a nozzle assembly 22 via a nozzle retainer 36. A timing plunger chamber 26 is defined by a portion of the central cylindrical bore 14, the lower exposed surface of the timing plunger 16 and the upper exposed face of the metering plunger 17. The metering barrel 34 is located between the interior portions of the injector body 10 and the nozzle 22. A metering chamber 33 is defined by the cylindrical bore 15 of the metering barrel 34, the lower exposed surface of the metering plunger 17 and the upper exposed surface of a nozzle spacer 23.

The timing plunger 16 protrudes into the base of the second central cylindrical bore 18 but is not mechanically coupled to the coupling member 20. The coupling member 20 abuts the timing plunger 16 such that only a compressive load may be transferred from the coupling member 20 to the timing plunger 16.

The coupling member 20 is equipped with an annular stop 65, located at the bottom end of the coupling member 20. The stop 65 limits the translation of the coupling member 20 in the direction of the injection stroke. Extending further radially outward on a flange 72 of the coupling member 20 is a spring seat 66, through which a return spring 68 acts upon the coupling member 20, biasing it upward in the direction of the metering stroke. The opposite end of the return spring 68 acts upon a spring seat 70, located on the injector body 10 at the base of a collar 74.

At the exposed end of the coupling member 20, a pocket 76 and a bearing surface 80 are formed, upon which a link 78 acts to force the coupling member 20 against the force created by the return spring 68 during the injection stroke. The link 78 is typically in direct or indirect contact with the injection train camshaft (not shown) and reciprocates along the central axis of the injector assembly 5 in response to the angular position of the actuating cam (not shown). Thus, rotational motion of the camshaft is converted into reciprocal motion of the injector assembly 5 axial components so as to provide force useful in pressurizing the timing plunger chamber 26 and, ultimately, the metering plunger chamber 33.

The basic operation of the injector is well known in the art. Fuel metering is controlled by the upward movement of the timing plunger 16 and the metering plunger 17, and the opening of a control valve 56. At the start of the metering stroke (as shown in FIG. 1), the timing plunger 16 is substantially bottomed against the metering plunger 17, the metering plunger 17 is bottomed against the nozzle spacer 23 and the control valve 56 is closed. As the cam profile allows the link 78 and the coupling member 20 to move upward under the urging of the spring 68 and the timing plunger 16 independently moves upward fuel flows into the injector assembly 5 via a fuel inlet port 45.

The fuel inlet port 45 is in communication with two separate fuel inlet branches. The first branch communicates the port 45 to the metering plunger chamber 33 through a metering inlet 49 and a metering check ball 35. The second branch communicates the port 45 to a control chamber 54, and ultimately the timing plunger chamber 26, through a control inlet passage 47. Fuel flow from the control chamber 54 to the timing plunger chamber 26 is accomplished by allowing fuel flow through the control valve 56, a control passage 50, a plunger chamber control orifice 48, and a plunger chamber passage 46 formed by an annular gap between the timing plunger 16 and the central cylindrical bore 14.

As the fuel enters the injector body 10, fuel at rail fuel pressure of 150 psi passes through the inlet passage 49 and opens the check valve 35 and enters the then very small volume of the metering plunger chamber 33. The pressure of the fuel acting on the bottom of the metering plunger 17 within metering plunger chamber 33 forces metering plunger 17 upward, thus creating additional pressure in timing plunger chamber 26. The pressure in timing plunger chamber 26 then acts on the bottom surface area of timing plunger 16, and causes an upward force to be developed thereon. Thus, both plungers move upward, with timing plunger 16 maintaining contact with coupling member 20. Fuel continues to flow through the check valve 35 into the expanding volume of the metering chamber 33 as long as the timing plunger 16 is moving upward and the control valve 56 is closed, which prevents fuel flow through the passage 50, the orifice 48 and the passage 46 into the collapsed timing plunger chamber 26. When a control solenoid 58 is actuated by well known means, the control valve 56 is caused to be opened and the metering of fuel into metering plunger chamber 33 ends. This is accomplished by the supply of fuel, also at rail fuel pressure of 150 psi, from the control chamber 54, through the control valve 56, the passage 50 and the orifice 48, and the passage 46 into the timing plunger chamber 26. Equal pressures then exist in both the timing plunger chamber 26 and the metering plunger chamber 33. The equal pressures acting on both ends of the metering plunger 17 exposed to hydraulic pressure tends to stop the upward motion of the metering plunger 17. Thus, a fixed amount of fuel will remain in the metering plunger chamber 33.

A bias spring 55, located within the timing plunger chamber 26 and bearing against the opposing surfaces of the timing plunger 16 and the metering plunger 17, ensures that the metering plunger 17 remains stationary and does not drift up as the timing plunger 16 continues to move upward within the injector body 10. The spring 55 also exerts enough force on the metering check ball 35, through the metering plunger 17 and the hydraulic link created by the fuel located in the metering plunger chamber 33, to keep the metering check ball 35 seated, preventing any change in the volume of fuel contained in the metering plunger chamber 33. Thus, a precisely metered quantity of fuel is trapped in the metering chamber 33. This fuel is the quantity of fuel that will be injected into the engine. The timing plunger 16 continues to rise and the timing plunger chamber 26 continues to be filled with fuel at rail fuel pressure until the end of the metering stroke.

Conversely, the start of the injection stroke is controlled by the downward movement of the timing plunger 16, again controlled by the cam profile and the mechanical linkage of the link 78 and the coupling member 20, and the closing of the control valve 56. As the timing plunger 16 begins to move downward due to the compressive force applied by the coupling member 20, the timing plunger 16 displaces the fuel present in the timing plunger chamber 26. The control solenoid 58 remains activated, which causes control valve 56 to remain open. This allows the displaced fuel from the timing plunger chamber 26 to flow from the timing plunger chamber 26, via the passage 46, the orifice 48 and the passage 50, back through the control valve 56 and into the control chamber 54. As the pressure in this hydraulic circuit is slightly above the rail fuel pressure of 150 psi, the displaced fuel is further caused to flow from the control chamber 54, through the fuel inlet passage 47 and the fuel inlet port 45, back to the fuel rail. This process is well known in the art as preinjection backflow and causes the pressures in the timing plunger chamber and the metering plunger chamber to remain constant.

At a predetermined crankshaft angle, the injection sequence begins. The control solenoid 58 is deactivated, causing the control valve 56 to close. Fuel is thus unable to backflow out of the timing plunger chamber 26 and is trapped in the timing plunger chamber 26, forming a hydraulic link between the timing plunger 16 and the metering plunger 17. The metering plunger 17 is forced to move downward with the continuing motion of the timing plunger 16, separated by the timing plunger chamber 26 volume.

As the load transferred from the cam and mechanical linkages increases against the contained hydraulic reservoirs created in the timing plunger chamber 26 and the metering plunger chamber 33, very high pressures are created in both chambers. When this pressure reaches a preset injection initiation pressure (i.e., 5000 psi), the pressure acting on a closed nozzle 27 causes the nozzle 27 to open, allowing fuel to be injected through the spray holes into the engine combustion chamber or equivalent structure. Injection continues, as the pressure continues to increase to nominally 20,000 psi, and occasionally 23,500 psi.

The end of the injection stroke is controlled via the metering barrel 34, which relieves the pressure in the timing plunger chamber 26 and the metering plunger chamber 33. Within metering barrel 34, a metering spill port orifice 28 is provided and allows selective fuel transportation ultimately between the metering plunger chamber 33 and the fuel rail (not shown), via the metering spill port orifice 28 and the metering spill port 24 located in a side wall 30 of the metering barrel 34. The metering barrel 34 is also provided with a timing spill port orifice 40. Selective fuel transportation between the timing plunger chamber 26, a timing spill edge 57, a timing spill port 38 and a return channel 42 is allowed via the timing spill orifice 40 located on the side wall 30 of the metering barrel 34. The return channel 42, forming an annular cavity on an interior surface 41 of the nozzle retainer 36, is in communication with a return port 44 and the typical fuel return circuit (not shown) directing fuel back to the fuel tank under low pressure. The metering plunger 17 is provided with the timing spill edge 57 and a metering spill edge 37, and is further provided with a metering passage 31, allowing ultimate communication between the metering spill port 24 and the metering plunger chamber 33.

Thus, as the metering spill edge 37 passes over the metering spill orifice 28, injection ceases. The communication provided to the metering spill port 24 through the metering spill passage 31, the metering spill edge 37 and the metering spill orifice 28 allows a rapid decay of pressure in the metering plunger chamber 33 and allows the nozzle 27 to close, resulting in the positive end of injection. The timing spill edge 57 passes over the timing spill orifice 40 immediately after the metering spill orifice 28 is obtained. This allows the fuel in the timing plunger chamber 26 to be spilled back to the fuel drain as the timing plunger 16 completes its downward movement. This completes the injection cycle.

In the preferred embodiment the axis of the control channel 50 is inclined with respect to the central axis of the injector body 10. The control channel 50 has an axis which intersects the central axis of injector body 10 at an angle $\alpha$. In the preferred embodiment the angle $\alpha$ is an acute angle with respect to the central axis of the injector body 10. The axis of control passage 50 is also substantially coaxial with the central axis of the control means comprising control valve 56 and control solenoid 58. Since the control solenoid 58 is mounted in the boss 94 in the injector body 10, the central axis of the boss 94 is also coaxial with the central axis of the control valve passage 50.

Since the axis of control passage 50, the axis of the control valve 56, the axis of the control solenoid 58 and the axis of the boss 94 are substantially coaxial, direct and uninterferred access to control passage 50 for purposes of drilling and/or machining is accomplished through the boss 94 provided for the control solenoid 58. Subsequent to the drilling of the passage 50, the control solenoid 58 is threadingly attached to the boss or aperture 94, thereby providing a positive seal against leakage of fuel under high pressure.

In the preferred embodiment the axis of the control valve passage 50 is substantially coaxial with the central axis of the boss 94 and due to the manner in which the control solenoid 58 and the control valve 56 are mounted also coaxial with the axis of the control valve 56 and the solenoid 58. It is also possible for the central axis of the control valve passage to intersect the central axis of the boss 94 provided that the point of intersection is sufficiently high up compared to the depth of the boss so that the central axis of the control valve passage would not intersect the side walls of the boss. It is necessary that the axis of the control valve passage 50 which intersects the central axis of the boss 94 also exit the opening of the boss 94 thereby assuring access through the boss 94 to the control valve passage 50 for machinery and drilling operations. In the preferred embodiment the position of a single control valve passage 50 has been described. It is within the scope of the present invention to have more than one passage within the injector body provided that the additional passages comply with the characteristics described above for the control valve passage 50.

Figure 2:
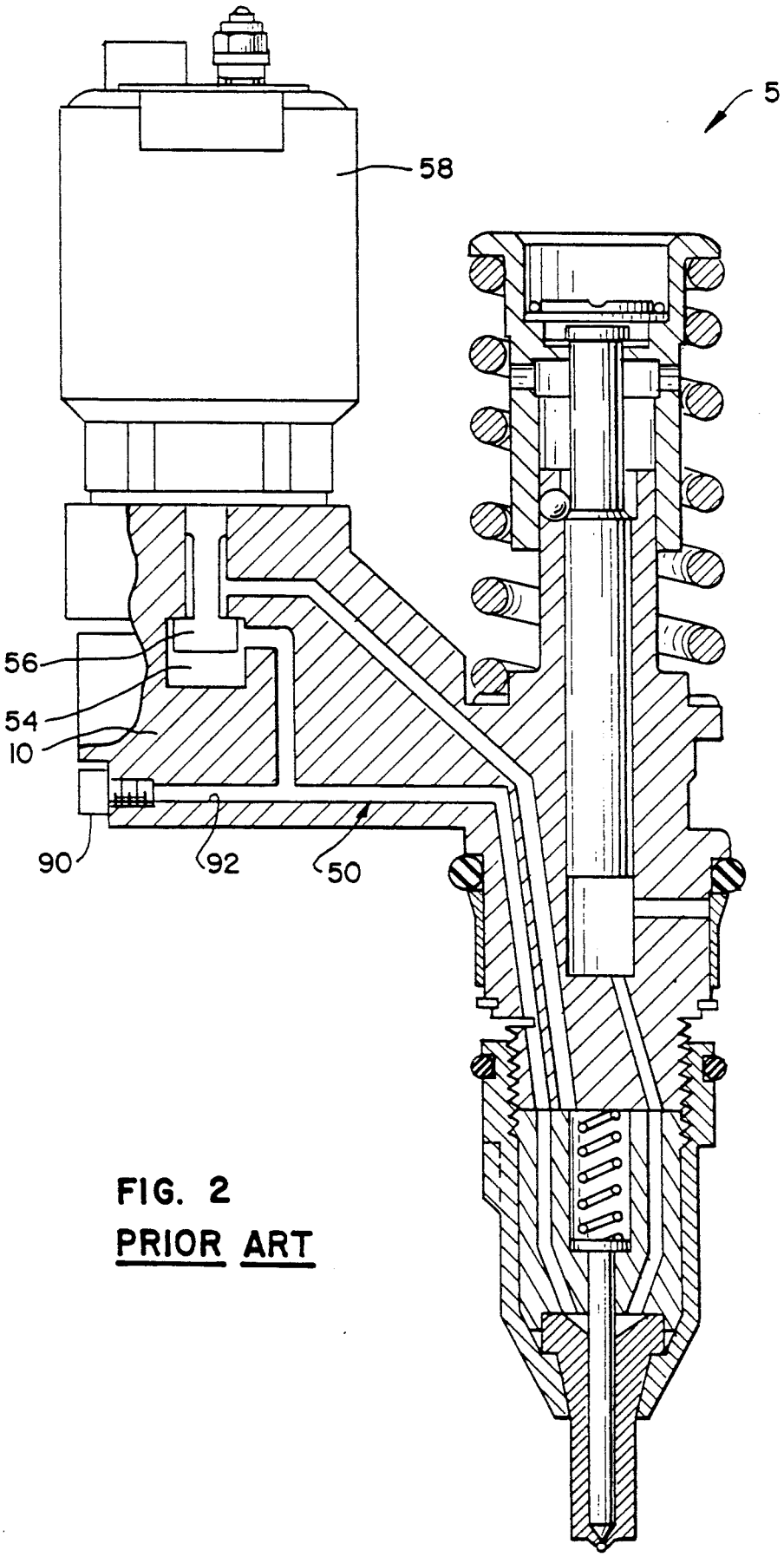
FIG. 2 PRIOR ART
FIG. 2 is a cross-sectional view of a typical high pressure fuel injector requiring plugs to seal the injector body exterior surface.

FIG. 2 depicts an injector assembly 5 without the beneficial repositioning of the control solenoid 58. The control solenoid 58 is positioned with its central axis parallel relative to the central axis of the injection body 10. The axis of control valve passage 50 is located perpendicular to both the axis of the control solenoid 58 and the axis of the injector body 10. Thus, machining and drilling operations necessary to the formation of interior passages, such as of central valve passage 50, cannot be accomplished with existing orifices in the injector body 10. In order to conduct machining and drilling of the control valve passage 50 special access orifices 92 must be formed in the injector body 10. A plug 90 is secured in each of the access orifices 92 to prevent leakage of fuel from the injection body 10. Due to packaging constraints placed on the configuration of the overall injector assembly 5, typical injector assemblies have the control solenoid 58 positioned vertically. The axis of the control solenoid is parallel to the axis of the injector body 10, as shown in FIG. 2. Under high pressure occurring during the injection stroke the plugs 90 can become dislodged causing a fuel leak or spill.

The timing plunger chamber 26 is in communication with the passage 46, the orifice 48 and the control passage 50. As timing plunger chamber 26 is exposed to the full range of pressures generated in the metering plunger chamber 33, the pressure experienced at the timing plunger chamber 26 can occasionally reach 23,500 psi. As the exterior drilling access 92 is also in communication with control passage 50, this extreme pressure is allowed to act against the sealing engagement of the plug 90. It is this pressure that creates the dislodgement of the plug 90.

Thus, a simple and inexpensive modification in the configuration of the control solenoid 58 orientation relative to the injector body 10 eliminates the need for plug 90. Drilling and machining of the control passage 50 is easily accomplished by drilling directly through the boss seat 94 of the control solenoid 58. The control solenoid 58 is thereafter threadingly attached to the injector body 10, thereby providing a far more reliable barrier against the leakage of fuel under high pressure from the exterior of the injector body 10.

A preferred embodiment of the present invention has been described, however, it is not intended to limit its spirit and scope. It will be understood that various changes in the details, arrangements and configuration of the parts which have been described and illustrated above in order to explain the nature of the present invention may be made by those skilled in the art within the principle and scope of the present invention as expressed in the appended claims.

What is claimed is:

1. A fuel injector for use in an internal combustion engine comprising:

a fuel injector body having a central axis, a receiving boss and a chamber for receiving a quantity of fuel, said chamber holding said fuel at high pressure during the injection process;

control means for controlling the quantity of said fuel received by said chamber, said control means having a central axis and being mounted to said injector body through said receiving boss;

said central axis of said control means intersecting said central axis of said injector body at an acute angle;

a passage formed in said injector body for providing continuous fuel communication between said control means and said chamber, said passage having a central axis;

means for pressurizing said fuel in said chamber;

said passage between said control means and said chamber being exposed to the pressure created in said fuel chamber by said pressurizing means;

said central axis of said passage being positioned substantially coaxially with the central axis of said control means; and, a nozzle in communication with said chamber for delivering said pressurized fuel into said engine.

2. The fuel injector of claim 1, wherein said passage being inclined to substantially the same degree as said central axis of said control means relative to the central axis of said injector body.

3. The fuel injector as set forth in claim 2, wherein;

said boss is positioned and sized to facilitate the machining of said passage directly through said boss into the interior of said injector body; and said control means being connected to said injector body for positively sealing said passage from the exterior of said injector body.

4. A fuel injector for use in an internal combustion engine comprising:

a fuel injector body having a central axis and a chamber for receiving a quantity of fuel, said chamber holding said fuel at high pressure during the injection process;

a boss formed in said injector body having an opening and a central axis;

control means for controlling the quantity of said fuel received by said chamber, said control means being mounted to said injector body through said opening in said receiving boss;

said central axis of said boss intersecting said central axis of said injector body at an acute angle;

a passage formed in said injector body for providing continuous fuel communication between said control means and said chamber, said passage having a central axis;

said central axis of said passage intersecting said central axis of said boss and extending through said opening of said boss; and, a nozzle in communication with said chamber for delivering said pressurized fuel into said engine.

5. A fuel injector for use in an internal combustion engine comprising:

a fuel injector body having a central axis, a receiving boss having an opening and a central axis, and a chamber for receiving a quantity of fuel, said chamber holding said fuel at high pressure during the injection process, control means for controlling the quantity of said fuel received by said chamber, said control means having a central axis and being mounted to said injector body through said opening in said receiving boss;

said central axis of said control means intersecting said central axis of said injector body at an acute angle;

a passage having a central axis formed in said injector body for providing continuous fuel communication between said control means and said chamber;

said central axis of said passage being positioned in substantially coaxial relation to said central axis of said control means and intersecting said central axis of said injector body at an acute angle;

means for pressurizing said fuel in said chamber;

said passage between said control means and said chamber being exposed to the pressure created in said fuel chamber by said pressurizing means;

said boss being situated to facilitate the machining of said passage directly through said boss into the interior of said injector body and to provide a sealing engagement with said control means to seal said passage from the exterior of said injector body; and a nozzle in communication with said chamber for delivering said pressurized fuel into said engine.

6. A fuel injector for use in an internal combustion engine comprising:

a fuel injector body having a central axis, a receiving boss having an opening and a central axis, a first chamber for receiving a metered quantity of fuel, and a second chamber for receiving a variable quantity of fuel, said first and second chambers holding said fuel at high pressure during the injection process, control means for controlling the quantity of said fuel metered into said first chamber, said control means having a central axis and being mounted to said injector body through said opening in said receiving boss;

said central axis of said control means intersecting said central axis of said injector body at an acute angle;

a passage having a central axis formed in said injector body for providing continuous fuel communication between said control means and said second chamber;

said central axis of said passage being positioned in substantially coaxial relation to said central axis of said control means and intersecting said central axis of said injector body at an acute angle;

means for pressurizing said fuel in said first and second chambers;

said passage between said control means and said second chamber being exposed to the pressure created in said second chamber by said pressurizing means;

said boss being situated to facilitate the machining of said passage directly through said boss into the interior of said injector body and to provide a sealing engagement with said control means to seal said passage from the exterior of said injector body; and a nozzle in communication with said first chamber for delivering said pressurized fuel into said engine.

7. The fuel injector as set forth in claim 6, wherein;

said control means has a first position providing fuel communication only to said first chamber and a second position providing fuel communication only to said second chamber through said passage;

said control means when in said first position metering said fuel into said first chamber for subsequent delivery of said fuel into said engine during the injection process and subsequently causing the initiation of said injection process; and said control means when is said second position allowing variable fuel communication through said passage to said second chamber and allowing preinjection backflow from said second chamber through said passage prior to the initiation of said injection process.

* * * * *